US006800027B2

(12) United States Patent
Giobbi et al.

(10) Patent No.: US 6,800,027 B2
(45) Date of Patent: Oct. 5, 2004

(54) SYSTEM AND METHOD FOR SAVING STATUS OF PAUSED GAME OF CHANCE

(75) Inventors: John J. Giobbi, Northbrook, IL (US); Larry J. Pacey, Prospect Heights, IL (US)

(73) Assignee: WMS Gaming Inc., Chicago, IL (US)

( * ) Notice: Subject to any disclaimer, the term of this patent is extended or adjusted under 35 U.S.C. 154(b) by 70 days.

(21) Appl. No.: 09/891,010

(22) Filed: Jun. 25, 2001

(65) Prior Publication Data

US 2001/0046893 A1 Nov. 29, 2001

Related U.S. Application Data

(63) Continuation-in-part of application No. 09/538,934, filed on Mar. 31, 2000, now Pat. No. 6,592,457.

(51) Int. Cl.[7] ..... A63F 9/24

(52) U.S. Cl. ..... 463/24; 463/16; 463/17; 463/18; 463/19; 463/20; 463/21; 463/22; 463/23; 463/25; 463/27; 463/29; 273/459

(58) Field of Search ..... 463/15, 40, 16–22, 463/23–29; 273/459, 460

(56) References Cited

U.S. PATENT DOCUMENTS

| | | | | |
|---|---|---|---|---|
| 3,281,149 | A | | 10/1966 | Miller |
| 4,095,795 | A | | 6/1978 | Saxton et al. |
| 4,306,768 | A | | 12/1981 | Egging |
| 4,335,809 | A | | 6/1982 | Wain |
| 4,448,419 | A | | 5/1984 | Telnaes |
| 4,508,345 | A | | 4/1985 | Okada |
| 4,624,459 | A | | 11/1986 | Kaufman |
| 4,721,307 | A | | 1/1988 | Okada |
| 4,752,068 | A | * | 6/1988 | Endo ..... 463/15 |
| 4,763,256 | A | | 8/1988 | DeMar |
| 4,772,023 | A | | 9/1988 | Okada |

(List continued on next page.)

FOREIGN PATENT DOCUMENTS

| | | |
|---|---|---|
| DE | 37 00 861 | 7/1988 |
| DE | 40 14 477 | 7/1991 |
| EP | 0 142 371 | 5/1985 |
| EP | 0 148 001 | 7/1985 |
| EP | 0 333 338 | 9/1989 |

(List continued on next page.)

OTHER PUBLICATIONS

Brochure Williams Gaming, Inc., "Batter Up!".
Brochure of Monopoly SWP Game; JPM Ltd., 4 pgs.; date unknown.
WMS' Big Money Advertisement Sheet; WMS Gaming Inc.; 1 pg.; date unknown.
WMS' Piggy Bankin' Advertisement Sheet; WMS Gaming Inc.; 1 pg.; date unknown.
WMS' Pirate's Thunder Advertisement Sheet; WMS Gaming Inc.; 1 pg.; date unknown.
Bally Circus Ad, excerpt from "Lemons, Cherries and Bell Fruit Gum"; Richard M. Bueschel; 3 pgs.; date unknown.
Bally Bingo Ad, excerpt from "Lemons, Cherries and Bell Fruit Gum"; Richard M. Bueschel; 1 pg.; date unknown.

(List continued on next page.)

*Primary Examiner*—Jessica Harrison
*Assistant Examiner*—Yveste Cherubin
(74) *Attorney, Agent, or Firm*—Jenkens & Gilchrist

(57) ABSTRACT

A game of chance involving a progression of events is conducted on one or more gaming machines. After receiving a wager from a player at a gaming machine, play of the game is initiated. If the game is paused, the status of the paused game is stored at a central database linked to and remote from the gaming machine. This game status is associated with a personal identifier of the player. To continue play of the game beginning from a point at which the game was paused, the personal identifier is provided to the central database via the same or another gaming machine and the game status associated with the personal identifier is retrieved from the central database.

10 Claims, 6 Drawing Sheets

U.S. PATENT DOCUMENTS

| | | | | | |
|---|---|---|---|---|---|
| 4,805,907 | A | | 2/1989 | Hagiwara | |
| 4,871,171 | A | | 10/1989 | Rivero | |
| 5,083,785 | A | | 1/1992 | Okada | |
| 5,169,147 | A | | 12/1992 | Hamano | |
| 5,205,555 | A | | 4/1993 | Hamano | |
| 5,259,616 | A | | 11/1993 | Bergmann | |
| 5,292,127 | A | | 3/1994 | Kelly et al. | |
| 5,342,047 | A | | 8/1994 | Heidel et al. | |
| 5,342,049 | A | | 8/1994 | Wichinsky et al. | |
| 5,380,008 | A | | 1/1995 | Mathis et al. | |
| 5,393,057 | A | | 2/1995 | Marnell, II | |
| 5,401,024 | A | | 3/1995 | Simunek | |
| 5,415,404 | A | | 5/1995 | Joshi et al. | |
| 5,429,361 | A | | 7/1995 | Raven et al. | |
| 5,449,173 | A | | 9/1995 | Thomas et al. | |
| 5,456,465 | A | | 10/1995 | Durham | |
| 5,456,466 | A | | 10/1995 | Miles | |
| 5,542,669 | A | | 8/1996 | Charron et al. | |
| 5,547,192 | A | | 8/1996 | Ishibashi | |
| 5,609,525 | A | * | 3/1997 | Ohno et al. | 463/43 |
| 5,624,119 | A | | 4/1997 | Leake | |
| 5,647,798 | A | | 7/1997 | Falciglia | |
| 5,664,781 | A | | 9/1997 | Feola | |
| 5,697,843 | A | | 12/1997 | Manship et al. | |
| 5,704,835 | A | | 1/1998 | Dietz, II | |
| 5,722,891 | A | | 3/1998 | Inoue | |
| 5,769,714 | A | | 6/1998 | Wiener et al. | 463/3 |
| 5,779,545 | A | | 7/1998 | Berg et al. | |
| 5,788,573 | A | | 8/1998 | Baerlocher et al. | |
| 5,823,874 | A | | 10/1998 | Adams | |
| 5,848,932 | A | | 12/1998 | Adams | |
| 5,951,397 | A | | 9/1999 | Dickinson | 463/36 |
| 6,007,427 | A | | 12/1999 | Wiener et al. | 463/17 |
| 6,012,983 | A | * | 1/2000 | Walker et al. | 463/20 |
| 6,077,163 | A | * | 6/2000 | Walker et al. | 463/26 |
| 6,135,885 | A | | 10/2000 | Lermusiaux | 463/20 |
| 6,165,071 | A | * | 12/2000 | Weiss | 463/24 |
| 6,234,896 | B1 | * | 5/2001 | Walker et al. | 463/16 |
| 6,273,820 | B1 | * | 8/2001 | Haste, III | 463/40 |
| 6,319,127 | B1 | * | 11/2001 | Walker et al. | 463/26 |
| 6,364,765 | B1 | * | 4/2002 | Walker et al. | 463/16 |
| 6,431,983 | B2 | * | 8/2002 | Acres | 463/25 |

FOREIGN PATENT DOCUMENTS

| | | |
|---|---|---|
| EP | 0 577 415 A2 | 1/1994 |
| FR | 1 474 617 | 4/1966 |
| GB | 1129607 | 10/1968 |
| GB | 1 476 848 | 6/1977 |
| GB | 1 591 623 | 6/1981 |
| GB | 2 066 991 | 7/1981 |
| GB | 2 072 395 | 9/1981 |
| GB | 2 083 936 | 3/1982 |
| GB | 2 084 371 | 4/1982 |
| GB | 2 096 376 | 10/1982 |
| GB | 2 097 160 | 10/1982 |
| GB | 2 105 891 | 3/1983 |
| GB | 2 106 685 | 4/1983 |
| GB | 2 117 952 | 10/1983 |
| GB | 2 147 442 | 5/1985 |
| GB | 2 147 773 | 5/1985 |
| GB | 2 152 262 | 7/1985 |
| GB | 2 153 572 | 8/1985 |
| GB | 2 157 047 | 10/1985 |
| GB | 2 165 385 | 4/1986 |
| GB | 2 170 636 | 8/1986 |
| GB | 2 180 087 | 3/1987 |
| GB | 2 181 589 | 4/1987 |
| GB | 2 183 882 | 6/1987 |
| GB | 2 191 030 | 12/1987 |
| GB | 2 197 974 | 6/1988 |
| GB | 2 202 984 | 10/1988 |
| GB | 2 204 436 | 11/1988 |
| GB | 2 210 191 | 6/1989 |
| GB | 2 222 712 | 3/1990 |
| GB | 2 226 907 | 7/1990 |
| GB | 2 229 565 | 9/1990 |
| GB | 2 230 373 | 10/1990 |
| GB | 2 233 806 | 1/1991 |
| GB | 2 242 300 | 9/1991 |
| GB | 2 253 154 | 9/1992 |
| GB | 2 262 642 | 6/1993 |
| GB | 2 270 787 | 3/1994 |
| GB | 2 273 384 | 8/1994 |
| GB | 2 287 567 | 9/1995 |
| GB | 2 297 857 | 8/1996 |
| GB | 2 298 508 | 9/1996 |
| WO | WO 8808179 | 10/1988 |
| WO | WO 8912875 | 12/1989 |
| WO | WO 9210818 | 6/1992 |
| WO | WO 9401840 | 1/1994 |

OTHER PUBLICATIONS

Las Vegas Slot Machine Ad, excerpt from "Lemons, Cherries and Bell Fruit Gum"; Richard M. Bueschel; 1 pg.; date unknown.

Phantom Haus website publication; Williams Electronics Games, Inc.; 2 pgs.; date unknown.

Arabian Riches website publication; Silicon Gaming Inc.; 2 pgs.; date Jul. 17, 1998.

Buccaneer Gold website publication; Silicon Gaming Inc.; 2 pgs.; date Jul. 17, 1998.

Fort Knox website publication; Silicon Gaming Inc.; 2 pgs.; date Jul. 17, 1998.

Lady of Fortune website publication; Silicon Gaming Inc.; 2 pgs.; date Jul. 17, 1998.

Riddle of the Sphinx website publication; Silicon Gaming Inc.; 2 pgs.; date Jul. 17, 1998.

Information Sheets for Kaleidoscope game; Williams Electronics Games, Inc.; 3 pgs.; date unknown.

Information Sheets for Double Wild & Loose Game; Williams Electronics Games, Inc.; 3 pgs.; date unknown.

Information Sheets for Wild Cherry (120A) Game; International Game Technology.; 2 pgs.; date Nov. 7, 1994.

Information Sheets for Double Wild Cherry (195A) Game; International Game Technology.; 3 pgs.; date Nov. 7, 1994.

Chapters 10, 11, 12; excerpts from "Lemons, Cherries and Bell–Fruit–Gum"; Richard M. Bueschel; 71 pgs.; 1995.

Advertisement, Club Vegas, Barcrest; 1 pg.; date unknown.

Advertisement, Viva Club Vegas!, Barcrest; 1 pg.; date unknown.

Advertisement, "Monopoly: Maygay There for the Taking"; 2 pgs.; date unknown.

Advertisement, "The Big Breakfast"; Channel Four Television Corporation; 2 pgs.; 1993.

Advertisement, "Midas Touch"; 2 pgs.; date unknown.

Advertisement, "Acropolis"; Automatic (Fruit) Designs, Ltd.; 2 pgs.; date unknown.

Advertisement, "Adders & Ladders"; Barcrest; 2 pgs.; date unknown.

Advertisement, "The Wild West"; Bell–Fruit Manufacturing; 2 pgs.; date unknown.

Advertisement, "Premier Club Manager"; Bell–Fruit Manufacturing; 2 pgs.; date unknown.

Advertisement, "Fortune Wheel"; Project Customer Services; 2 pgs.; date unknown.

Advertisement, "Road Hog"; Barcrest; 2 pgs.; date unknown.
Advertisement, "Viva! Six! Las Vegas"; Barcrest; 2 pgs.; date unknown.
Advertisement, "Golden Circle"; Delta Automaten; 1 pg.; date unknown.
Advertisement, "Club Double"; M–D–M Coin Sales Ltd.; 2 pgs.; date unknown.
Advertisement, "Treasure Island"; American Alpha, Inc.; 1 pg.; date unknown.
Advertisement, "Bonus Card"; Andries Robert Automatic s.p.r.l.; 1 pg.; date unknown.
Advertisement, "Super Square"; Maygay Machines Ltd.; 2 pgs.; date unknown.
Advertisement, "Lucky Bank"; 1 pg.; date unknown.
Advertisement, "Happy Clown"; Andries Robert Automatic s.p.r.l.; 1 pg.; date unknown.
Advertisement, "Jackpot Stampede"; WMS Gaming Inc.; 2 pgs.; date unknown.
Brochure, "Perfect Universal Slot Machines"; Universal Co., Ltd.; 16 pgs.; date unknown.
Advertisement, "Club Make a Million"; Bell–Fruit Manufacturing Co., Ltd.; 2 pgs.; date unknown.
Advertisement, "Instant Jackpots"; Bell–Fruit Manufacturing Co., Ltd.; 2 pgs.; date unknown.
Cover page, "Enter Disposable Gaming"; *Euroslot. The International Coin–Operated Machine Journal*; 1 pg.; Apr., 1994.
Advertisement, Barcrest Limited; 1 pg.; date unknown.
Cover page, "Covers Your World"; *Euroslot. The Currency of the Coin Machine Industry*; 1 pg.; date unknown.
Article, "Bangkok on the Brink"; *Euroslot. The International Coin–Operated Machine Journal*; 2 pgs.; Nov., 1993.
Article, "Scandinavia on the Brink of the EU melting pot"; *Euroslot. The International Coin–Operated Machine Journal*; 2 pgs.; Aug., 1994.
Advertisement, "Only Fools and Horses"; Bell–Fruit Manufacturing Co., Ltd.; 2 pgs.; date unknown.
Advertisement, "Main Attraction"; Bell–Fruit Manufacturing Co., Ltd., 2 pgs.; date unknown.
Brochure, "World Players"; Barcrest; 6 pgs.; date unknown.
Brochure, "JPM Presents Monopoly Deluxe"; JPM International Ltd.; 5 pgs.; date unknown.
Brochure, "The 50th Show"; Ate International; 2 pgs.; Jan., 1994.
Advertisement, "Colossus"; AFD.; 1 pg.; date unknown.
Advertisement, "Wheel of Fortune"; Project Creating Entertainment; 2 pgs.; date unknown.
Advertisement, "Lucky Horseshoes"; JPM Automatic Machines Ltd.; 2 pgs.; date unknown.
Advertisement, "Lucky Jackpots"; JPM Automatic Machines Ltd.; 2 pgs.; date unknown.
Advertisement, "Monopoly"; JPM Automatic Machines Ltd.; 2 pgs.; date unknown.

* cited by examiner

SYSTEM AND METHOD FOR SAVING STATUS OF PAUSED GAME OF CHANCE

REFERENCE TO RELATED APPLICATIONS

This application is a continuation-in-part of application Ser. No. 09/538,934, filed Mar. 31, 2000 now U.S. Pat. No. 6,592,457.

FIELD OF THE INVENTION

The present invention relates generally to games of chance and, more particularly, to a system and method for storing the status of a paused game of chance at a central database linked to and remote from a gaming machine.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning on each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operators. Traditional gaming machines use mechanical slot reels or video depictions of such reels to display games and outcomes to players. Further, many traditional gaming machines use simulations of standard casino games such as cards, dice, bingo and the like to attract players. These traditional machines may become repetitive over time, and it is believed that more innovative displays and gameplay features will find success by offering players an interesting and exciting alternative to traditional games. Accordingly, in the competitive gaming machine industry, there is a continuing need for gaming machine manufacturers to produce new types of games, or enhancements to existing games, which will attract frequent play by enhancing the entertainment value and excitement associated with the game. In particular, there is a need for engaging and entertaining games that can hold a player's interest more than existing games. The present invention is directed to satisfying this need.

SUMMARY OF THE INVENTION

In accordance with one aspect of the present invention, a game of chance involving a progression of events is conducted on one or more gaming machines. After receiving a wager from a player at a gaming machine, play of the game is initiated. If the game is paused, the status of the paused game is stored at a central database linked to and remote from the gaming machine. This game status is associated with a personal identifier of the player. To continue play of the game beginning from a point at which the game was paused, the personal identifier is provided to the central database via the same or another gaming machine and the game status associated with the personal identifier is retrieved from the central database.

BRIEF DESCRIPTION OF THE DRAWINGS

The foregoing and other advantages of the invention will become apparent upon reading the following detailed description and upon reference to the drawings in which.

Figure 1:
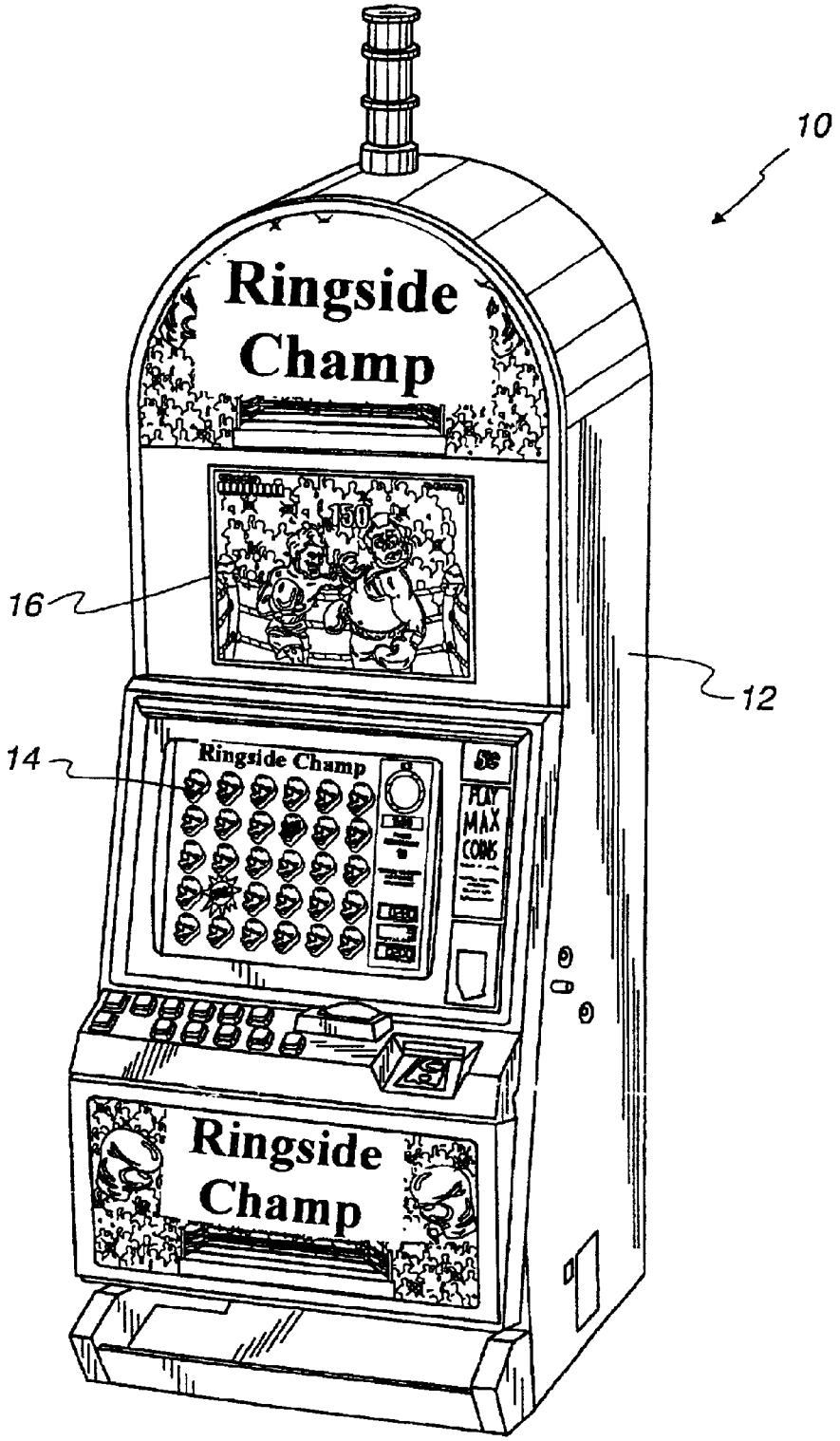
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a video gaming machine 10 that may be used to implement a game according to the present invention. The gaming machine 10 includes a large bonnet-top cabinet 12 containing two video displays 14 and 16. Each of the video displays 14 and 16 may comprise a dot matrix, CRT, LED, LCD, electro-luminescent display or generally any type of video displays known in the art. One or both of the video displays 14 and 16 may incorporate a touch-screen input device. In the illustrated embodiment, the gaming machine 10 is an "upright" version in which the video displays 14 and 16 are oriented vertically relative to the player. It will be appreciated, however, that any of several other models of gaming machines are within the scope of the present invention including, for example, a single video display and more than two video displays. Furthermore, a "slant-top" version containing the video display(s) that is slanted at about a thirty-degree angle toward the player may be used.

In one embodiment, the gaming machine 10 is operable to play a game entitled RINGSIDE CHAMP™ having a boxing theme. In another embodiment, the gaming machine 10 is operable to play a game having a football theme. In alternative embodiments, the gaming machine 10 may provide different games and/or any of several alternative game themes. The RINGSIDE CHAMP™ game features a basic game with player selected events in the form of a boxing match (see FIGS. 3*a* and 3*b*). The RINGSIDE CHAMP™ game may also include a bonus game or secondary game.

Figure 2:
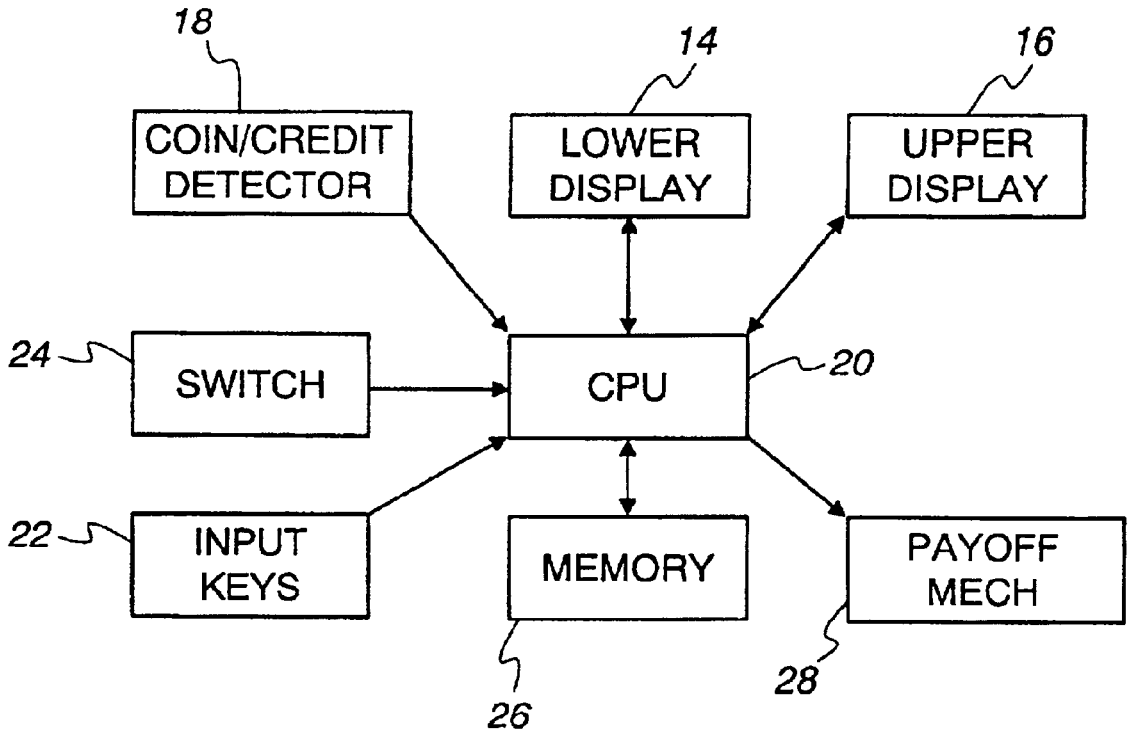
FIG. 2 is a block diagram of a control system suitable for operating the gaming machine in FIG. 1.

FIG. 2 is a block diagram of a control system including processing circuitry suitable for operating the gaming machine 10. Coin/credit detector 18 signals a CPU 20 when a player has inserted a number of coins or played a number of credits. Then, the CPU 20 operates to execute a game program which causes the lower video display 14 to display the basic game that includes a series of player selectable options displayed thereon (see FIGS. 3*b* and 4*b*). The player may select the amount to wager via an input key 22. A play of the game commences in response to the player activating a switch 24 corresponding to a displayed option (e.g., by pushing a button or touching a touch screen), causing the CPU 20 to randomly select a game outcome and animate the game outcome on the upper display 16. Animation may take any of several forms; for example, the animation may be hand-drawn animation showing an action, computer animated action, video or film representations, or any other visible movement corresponding to a selected option. In one embodiment, the game outcome may be displayed via mechanical devices which carry out an action in response to the player's selection of an option. In addition, the depiction of the outcome of an option selected by a player may be displayed using a combination of these forms of animation. In one embodiment, certain of the basic game outcomes cause the CPU 20 to enter a bonus mode causing the video displays 14 and 16 to show a bonus game.

A system memory 26 stores control software, operational instructions and data associated with the gaming machine 10. In one embodiment, the memory 26 comprises a separate read-only memory (ROM) and battery-backed random-access memory (RAM). However, it will be appreciated that the system memory 26 may be implemented on any of several alternative types of memory structures or may be implemented on a single memory structure. A payoff mechanism 28 is operable in response to instructions from the CPU 20 to award a payoff of coins or credits to the player in response to certain winning situations which might occur in the game. The payoff amounts corresponding to certain outcomes in the basic game are predetermined according to a pay table stored in system memory 26. The payoff amounts corresponding to certain outcomes of the bonus game are also stored in system memory 26. Furthermore, the system memory 26 stores data relating to the images to be shown on the lower and upper displays 14 and 16.

Figure 3A:
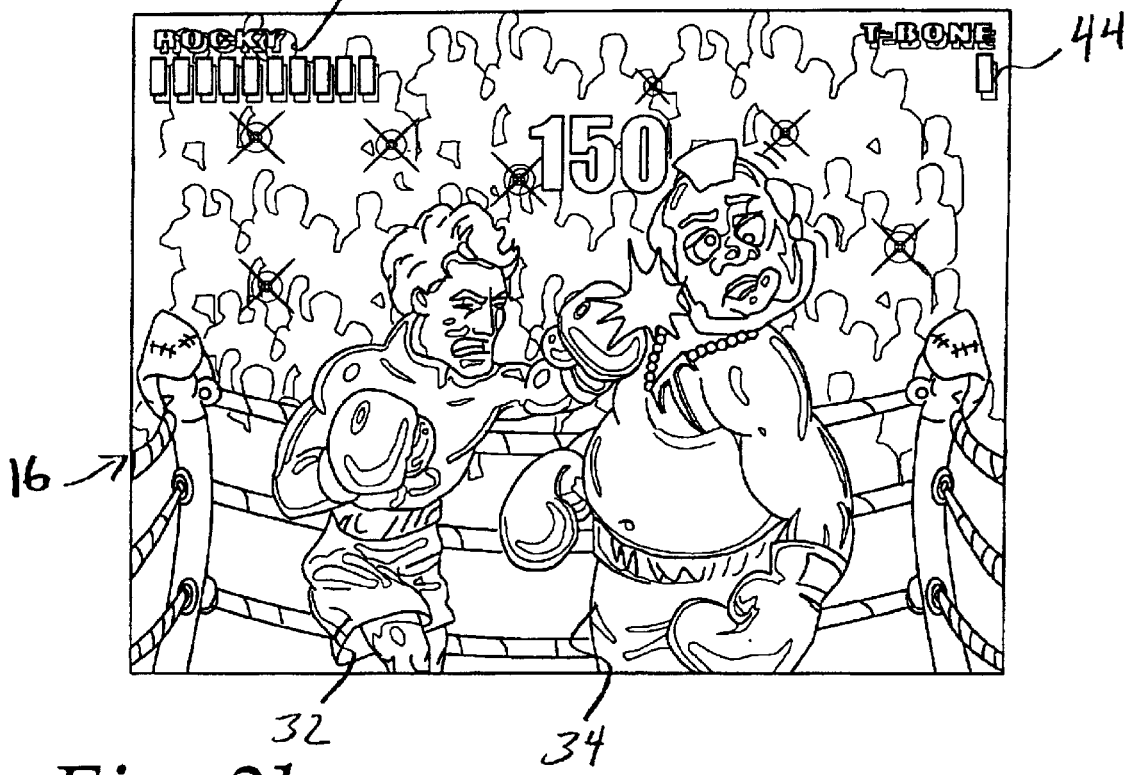
FIGS. 3*a* and 3*b* are display screen captures associated with a boxing game that is played on the gaming machine in FIG. 1.
Figure 3B:
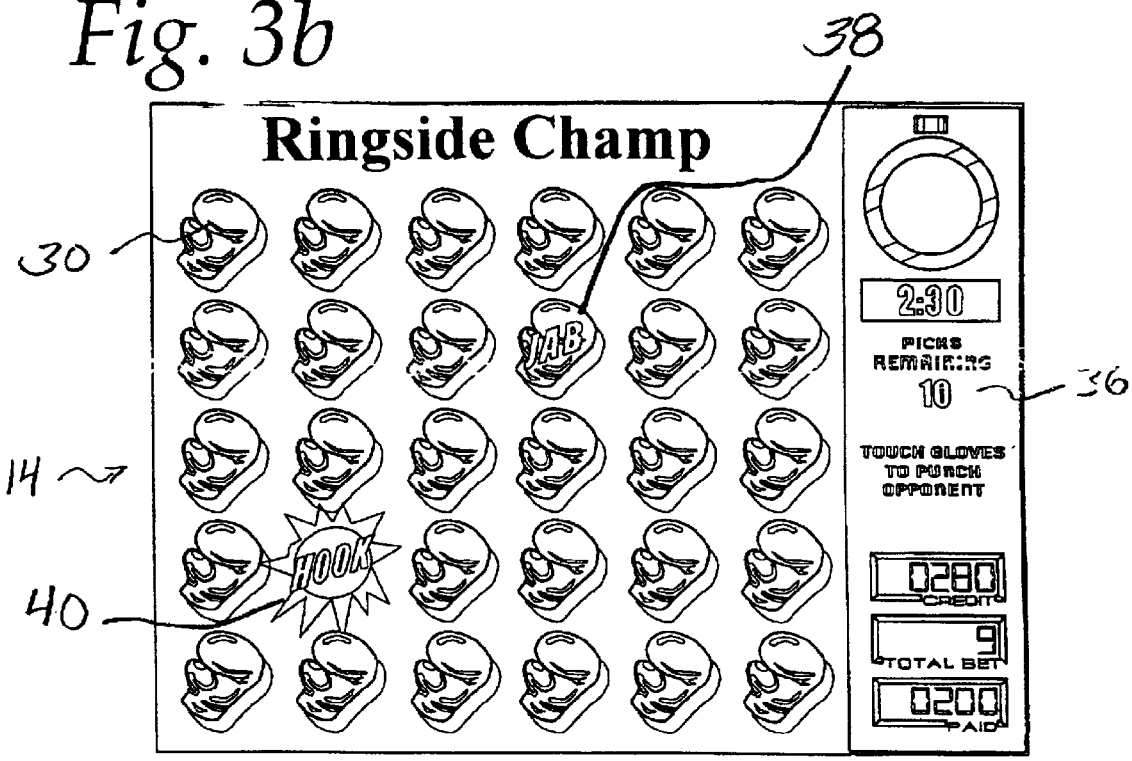

As shown in FIGS. 3*a* and 3*b*, the RINGSIDE CHAMP™ basic game is implemented on the video displays 14 and 16. As illustrated in FIG. 3*b*, the lower display 14 presents an array of boxing gloves 30. As illustrated in FIG. 3*a*, the upper display presents an animation of a boxing match with two boxers "Rocky" 32 and "T-Bone" 34. Generally, game play is initiated by inserting a number of coins or playing a number of credits, causing the CPU 20 (FIG. 2) to activate a number of picks available to the player corresponding to the number of coins or credits played. The lower display 14 illustrates the number of picks 36 or selections available to the player.

After picks 36 are made available to the player, the lower display 14 informs the player "TOUCH GLOVES TO PUNCH OPPONENT." The CPU 20 uses a random number generator (not shown) to select a punch type for each of the displayed gloves 30. In one embodiment, the punch type for each glove 30 is written over the gloves 30 as shown by the "JAB" glove 38. For convenience, this embodiment is called the options revealed embodiment. In another embodiment, a punch type or outcome for each glove is not revealed until the player selects a glove such as the revealed "HOOK" glove 40. For convenience, this embodiment is called the options hidden embodiment. For both the options revealed and options hidden embodiments, the player selects one of the boxing gloves 30. In one embodiment, the lower display 14 includes a touch screen to allow the player to press the desired boxing glove 30.

In the options revealed embodiment, once the player selects one of the boxing gloves 36, the selected option animates on the upper display 16. For the example illustrated in FIGS. 3*a* and 3*b*, the JAB option 38 has been selected and ROCKY throws a jab punch. The CPU 20 randomly determines a punch outcome for the selected JAB option 38. The punch outcome is a result for the thrown punch having a payoff, such as a missed punch equaling no payoff, a blocked punch equaling no payoff, a soft hit equaling 10 credits, a medium hit equaling 50 credits, a solid hit equaling 150 credits, a knock down equaling 250 credits and a knock out equaling 500 credits. For example, the JAB punch may result in the solid hit as animated on the upper display 16 in FIG. 3*a* with the JAB punch connecting with the face of T-Bone resulting in a 150 credit payoff to the player. Table 1 illustrates a pay table for the RINGSIDE CHAMP™ basic game. In the options revealed embodiment, the punches are shown to the player before the player's selection, but the outcomes of the punches are randomly determined following the player's selection.

TABLE 1

Pay Table for Options Revealed Embodiment

| PUNCH OUTCOME | PAYOFF |
|---|---|
| MISSED PUNCH | 0 |
| DEFLECTED PUNCH | 0 |
| SOFT HIT | 10 |
| MEDIUM HIT | 50 |
| SOLID HIT | 150 |
| KNOCK DOWN | 250 |
| KNOCK OUT | 500 |

The options hidden embodiment is similar to the options revealed embodiment. Once the player selects one of the boxing gloves 36, the selected boxing glove animates on the lower display 14 revealing either a punch type, such as HOOK 40 in FIG. 3*b*, or an outcome for the selected boxing glove. If a punch type is revealed, the CPU 20 determines a punch outcome for the revealed punch type, such as the HOOK punch 40. The punch outcome is a result for the thrown punch having a payoff value, such as a missed punch equaling no payoff, a deflected punch equaling no payoff, a soft hit equaling a small payoff, a medium hit equaling a medium payoff, or a solid hit equaling a large payoff. For example, the HOOK punch may result in the solid hit as animated on the upper display 16 in FIG. 3*a* for the JAB punch resulting in a 150 credit payoff to the player. In the options hidden embodiment, the punches or outcomes corresponding to the boxing gloves may be randomly determined before the player selects a boxing glove 30. Alternatively, the punches or outcomes corresponding to the boxing gloves may be randomly determined after the player selects a boxing glove 30. In one embodiment, all of the hidden punches, defensive moves, and/or punch outcomes may be displayed after the player selects one of the boxing gloves.

For both the options revealed embodiment and the options hidden embodiment, the upper display 16 presents a score card 42 for ROCKY and a score card 44 for T-BONE. In one embodiment, the score cards 42 and 44 track and illustrate the punch outcomes for the player. In another embodiment, the score cards reflect the energy or power remaining for the player and the opponent. In this embodiment, the game may pause when ROCKY's score card 42 is depleted to zero to allow the player to place a new wager and increase ROCKY's score card. Further, in this embodiment some boxing gloves may be associated with block or dodge moves that allow the player to avoid getting hit and losing energy or power. Using this embodiment, the player may decide whether to play offensively or defensively to arrive at the best outcome. Following the player's selection of a boxing glove and the machine's depiction of the outcome, the boxing match illustrated on the upper display 16 continues allowing the player to select another boxing glove 30. The punch outcome of the selected boxing gloves 30 is reflected on the score cards 42 and 44. Thus, the boxing match becomes a continuing gameplay experience in which the player participates. As the gameplay experience continues, a connecting punch may result in a knockdown or a knockout, in which case bonus payoffs may be rewarded in addition to the payoffs for connecting punches.

In one embodiment of the RINGSIDE CHAMP™ game, the player can be given the option to place wagers on multiple events or achievements within the boxing game. For example, a player may place bets on who will win the bout, the outcome of the bout (for example, a knockout, a TKO, or a decision), the number of punches that are thrown or that land in a bout, and the like. These wagers may be placed at the beginning of the RINGSIDE CHAMP™ game or after the game has begun.

Figure 5:
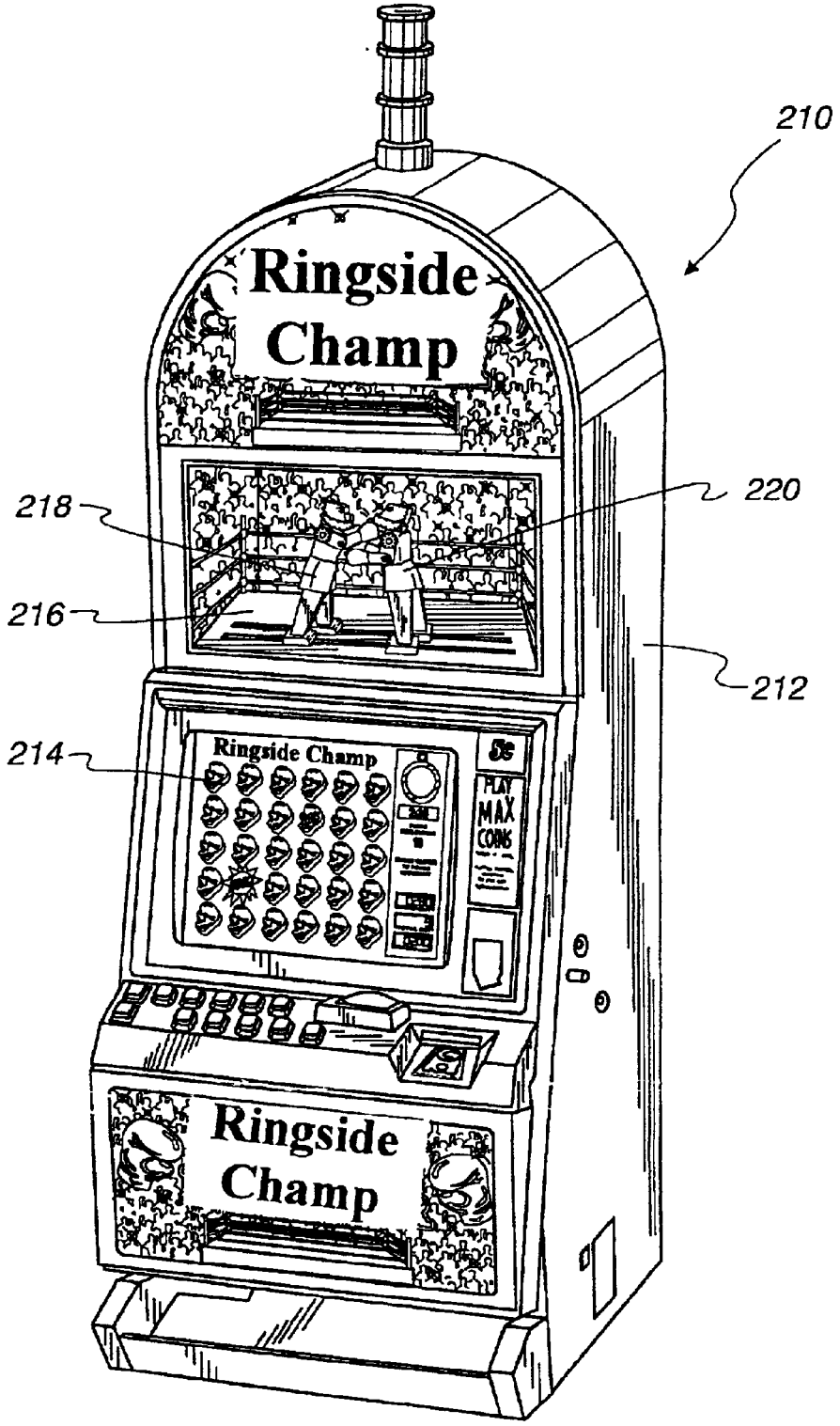
FIG. 5 is a perspective view of a gaming machine for playing one embodiment of the present invention.

Further, in addition to being shown on an upper display 16, the outcomes of selections by a player and the progression of the present invention may be shown via mechanical devices as illustrated in FIG. 5. In this embodiment the gaming machine 210 has a stand-up cabinet 212 with a lower display 214 and an upper mechanical display 216. In the RINGSIDE CHAMP™ embodiment, a mechanical actor representing the player 218 and a mechanical actor representing the opponent 220 provide a physical representation of the outcomes and progression of the game as selected by the player. The mechanical display could further be used in other embodiments, where the mechanical display may depict vehicles, teams, or other objects.

Figure 4A:
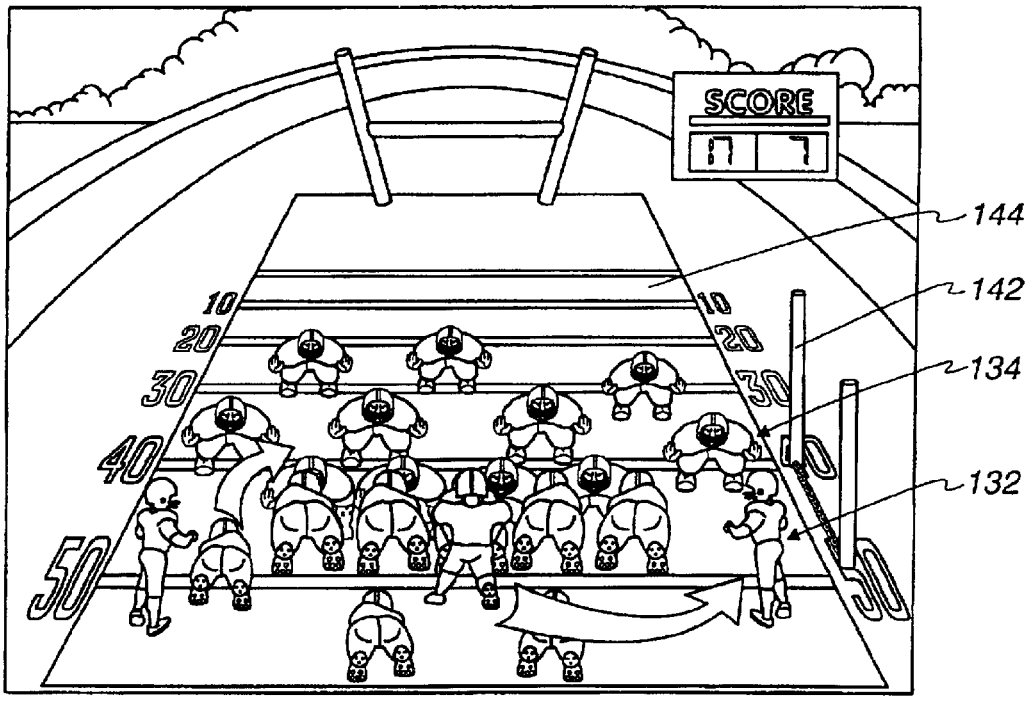
FIGS. 4*a* and 4*b* are display screen captures associated with a football game that is played on the gaming machine in FIG. 1.
Figure 4B:
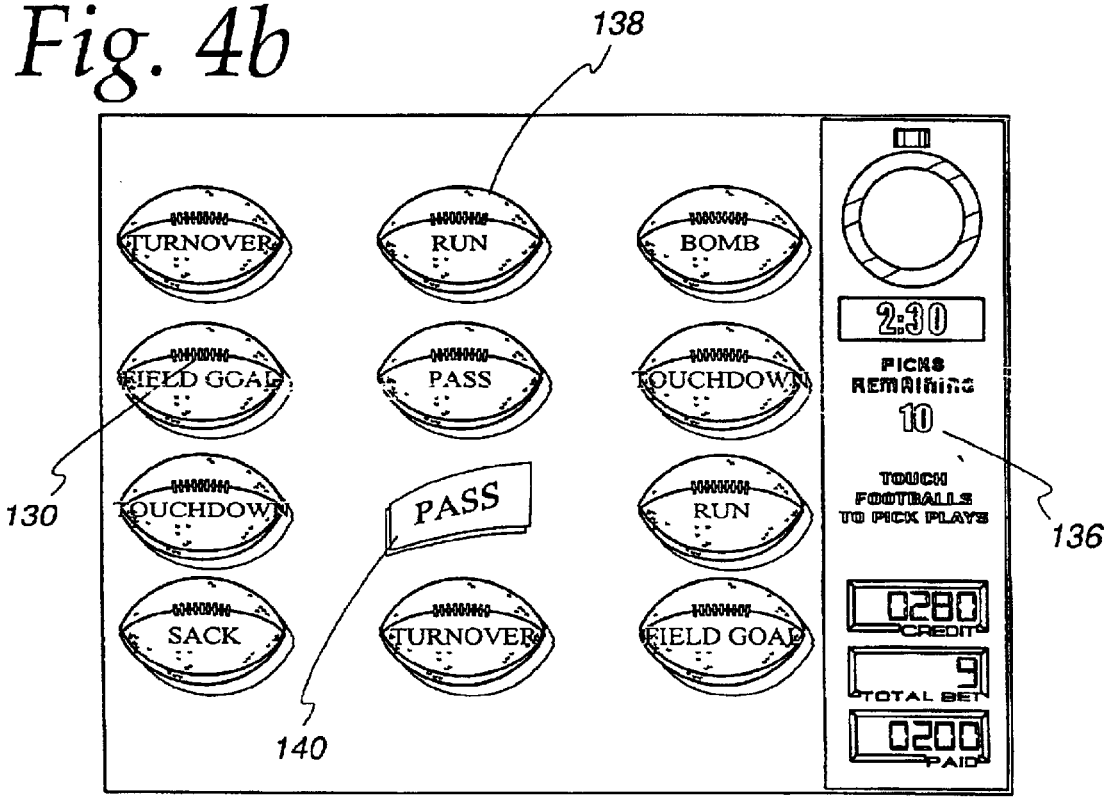

In another embodiment, the gaming machine 10 is operable to play a game entitled "football" having an American football theme. As shown in FIGS. 4*a* and 4*b*, the football basic game is similarly implemented on the video displays 14 and 16 as the RINGSIDE CHAMP™ game. As illustrated in FIG. 4*b*, the lower display 14 presents an array of footballs 130. As illustrated in FIG. 4*a*, the upper display presents an animation of a football game with two teams "Home" 132 and "Visitor" 134. Generally, game play is initiated by inserting a number of coins or playing a number of credits, causing the CPU 20 (FIG. 2) to activate a number of picks available to the player corresponding to the number of coins or credits played. The lower display 14 illustrates the number of picks 136 or selections available to the player.

After picks 136 are made available to the player, the lower display 114 informs the player "TOUCH FOOTBALLS TO PICK PLAYS." The CPU 20 uses a random number generator (not shown) to select a play type for each of the displayed footballs 130. In one embodiment, the play type for each football 130 is written over the football 130 as shown by the "RUN" football 138. For convenience, this embodiment is called the options revealed embodiment. In another embodiment, the play type or outcome for each football is not revealed until the player selects that football such as the revealed "PASS" football 140. For convenience, this embodiment is called the options hidden embodiment. For both the options revealed and options hidden embodiments, the player selects one of the footballs 130. In one embodiment, the lower display 14 is a touch screen to allow the player to press the desired football 130.

In the options revealed embodiment, once the player selects one of the footballs 130, the selected option animates on the upper display 16. For the example illustrated in FIGS. 4*a* and 4*b*, the RUN option 138 has been selected and the HOME team executes a run play. The CPU 20 randomly determines a play outcome for the selected RUN option 138. The play outcome is a result for the executed play having a payoff value, such as a loss of yardage equaling no payoff, no gain equaling no payoff, short gain equaling a small payoff, a long gain equaling a medium payoff, and a touchdown equaling a large payoff. For example, the RUN play may result in the short gain as animated on the upper display 16 in FIG. 4*a* providing a 10 credit payoff to the player. Table 2 illustrates a pay table for the football basic game.

TABLE 2

Pay Table for Options Revealed Embodiment

| PLAY OUTCOME | PAYOFF |
|---|---|
| LOSS OF YARDAGE | 0 |
| NO GAIN | 0 |
| SHORT GAIN | 10 |
| MEDIUM GAIN | 50 |
| LONG GAIN | 150 |
| FIELD GOAL | 250 |
| TOUCHDOWN | 500 |

The options hidden embodiment is similar to the options revealed embodiment. Once the player selects one of the footballs 130, the selected football animates on the lower display 14 revealing the play or play outcome, such as PASS 140 in FIG. 4*b*. In the options hidden embodiment, the plays or play outcomes may be randomly determined by the CPU 20 either before the player selects a football 130 or after the player selects a football 130. In the current example, the CPU 20 randomly determines a play outcome for the selected PASS option 140. Alternatively, in the options hidden embodiment, the CPU 20 could randomly choose a play outcome such as "TOUCHDOWN" to correspond to a football 130. The play outcome is a result for the executed play having a payoff value, such as a loss of yardage equaling no payoff, no gain equaling no payoff, short gain equaling small payoff, a long gain equaling a medium payoff, and a touchdown equaling a large payoff. For example, the PASS play may result in the long gain resulting in a 150 credit payoff to the player. In one embodiment, all of the hidden plays and/or play outcomes may be displayed after the player selects one of the footballs.

For both the options revealed embodiment and the options hidden embodiment, the upper display 16 presents a first down marker 142 for the HOME team. The first down marker 142 tracks and illustrates the yardage gained by the play outcomes for the player. The football game illustrated on the upper display 16 continues allowing the player to select another football 130. The play outcome of the later selected footballs 130 is illustrated as progress with respect to the first down marker 142 and the end zone line 144. Progress may also be shown by a scoreboard 146 on the upper display 16. Although not shown in the pay table, payoffs may also be awarded for field goals, kickoff returns, punt returns, and other types of football plays. In one embodiment, the football game continues after the player scores, so that the player plays on defense rather than offense. In this embodiment, the footballs 130 show defensive play types when the player is on defense, and the player may receive payoffs for successful defensive plays or for stopping the opposing team from scoring or advancing the ball.

In one embodiment, the footballs 130 initially correspond to football formations. In this embodiment, when a player selects a formation the footballs 130 alter so that they correspond to individual plays using the selected formation.

This embodiment may be employed with either offensive or defensive plays. Further, schematic diagrams of a play choice may be displayed.

In addition to the RINGSIDE CHAMP™ and football games described above, the present invention may be implemented in connection with a wide variety of a lifelike representations of other sports, such as, for example, baseball, hockey, basketball, soccer, tennis, automobile or horse racing, golf, track-and-field, or bowling events. In all embodiments, the game selected is other than slots, cards, roulette, dice, dominoes, bingo, or keno. In one embodiment, in addition to the wager and play features described above, the player may place optional wagers on overall outcomes of a continuing gameplay experience. For example, in the RINGSIDE CHAMP™ game, a player may be able to wager on such outcomes as who will win a bout, how many punches each competitor with throw or land, and the overall number of rounds in the bout. Likewise, in the football game, a player may be able to wager on such outcomes as the winner of the game, the margin of victory, the points scored by each team or the teams combined, the overall yardage gained or lost by each team, pass completion percentage, and other such statistics.

Optional wagers may be placed at the same time as the wagers that start the game, or they may be placed during the game so as to alter the possible payoffs resulting from the outcomes. Different wagers may be accepted based on the complexity of the game desired by the player; if a player desires a very complex game with many statistics to wager on, many different optional wagers may be accepted. Alternatively, a player may wish only to play a simple play with no wagers other than the basic wagers used to play the game, and therefore the game will be limited to accepting less complex wagers.

In one embodiment of the present invention, a large jackpot may be provided to players who achieve an especially rare accomplishment in the game. For example, in the RINGSIDE CHAMP™ game, a large jackpot can be awarded if the player achieves a first-round knockout. Similarly, in the football game, a large jackpot can be awarded if the player scores an unusually high point total or if the player keeps the opposing team from scoring any points.

Figure 6:
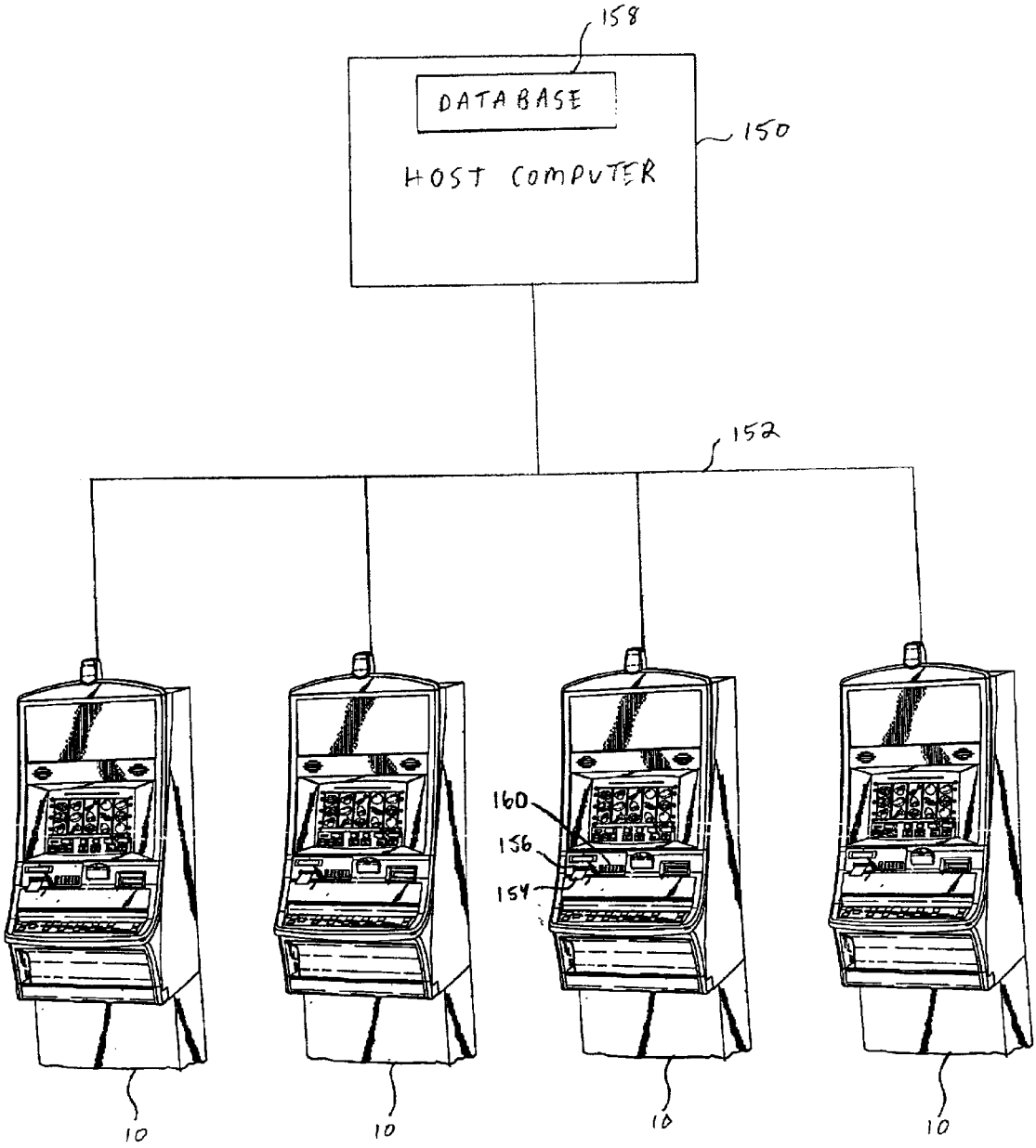
FIG. 6 is a schematic diagram of a system for linking multiple gaming machines to a central host computer.

In another embodiment of the present invention, a player may pause a game before the conclusion of the game. Toward that end, referring to FIG. 6, the gaming machine 10 may be linked along with other gaming machines 10 to a "back-end" central host computer 150 via a high-speed local or wide area computer network 152. The computer network 152 may employ a data transfer protocol such as 100 Base-T Ethernet or Gigabit Ethernet, which support data transfer rates of 100 megabits per second and 1 gigabit per second, respectively. Alternatively, the gaming machines 10 and the host computer 150 may each be outfitted with transceivers that support two-way wireless communication. Each gaming machine 10 is assigned a respective permanent identification number (PIN) for identifying the machine 10 to the host computer 150 and allowing the host computer 150 to address the machine 10.

The central computer 150 may be used to extract accounting data from the individual gaming machines 10 as well as provide player tracking. An example of a data collection system is described in U.S. Pat. No. 4,283,709 issued to Lucero et al. Network systems such as described in Lucero et al. allow the host computer 150 to monitor the usage and payout, collectively known as audit data, of the individual gaming machines 10. This audit data includes data related to the number of coins or tokens inserted into the machine, the number of times the machine has been played, the amount paid in raises, the number and the type of jackpots paid by the machine, the number of door openings, etc. The host computer 150 can then compile an accounting report based on the audit data from each of the individual gaming machines 10. This report can then be used by management, for example, to assess the profitability of the individual gaming machines 10.

Player tracking, as the name indicates, involves tracking individual player usage of the gaming machines 10. In a typical player tracking system, the player is issued a player identification card 154 which has encoded thereon a player identifier such as a personal identification number or code that uniquely identifies the player. The player identification card 154 may be in the form of a smart card, magnetic card, or other memory device and may also be used for cashless gaming. If the card 154 is used for cashless gaming, funds may be stored directly on the card or in a database at the host computer 150. The individual gaming machines 10 are each fitted with a respective card reader 156 into which the player inserts a player tracking card 154 prior to playing the associated gaming machine 10. The card reader 156 reads the personal identifier off the card 154 and informs the host computer 150 linked thereto of the player's subsequent gaming activity. The host computer 150 preferably includes a database 158 containing a personal record associated with the player's personal identifier. The personal identifier on the card 154 is used to address and retrieve this personal record. By tracking the individual players, individual player usage can be monitored by associating certain of the audit data with the players' personal identifiers. This allows gaming establishments to target individual players with direct marketing techniques according to the individual's usage.

In addition to being used for player tracking and cashless gaming, the player identification card 154 may be used to save/record the status of a game involving a continuing performance or progression of events when the player chooses to pause the game. The game may be paused at any time the player wishes. When paused, the status of the game is preferably saved in the player's personal record in the database 158 at the host computer 150. Then, when the player wants to resume the game, the player may input the player identification card 154 into any of the gaming machines 10 that execute that game. The gaming machine then addresses the personal database record associated with the personal identifier on the card 154, retrieves the last status of the paused game, and configures itself to initiate play of the game from the point at which the game was paused.

Instead of identifying a player to the host computer 150 using a personal identifier on the player identification card 154, the player may be identified by biometrics (e.g., fingerprint, eye scan, etc.) or by a personal identifier manually entered via a keypad 160 or touch screen at the gaming machine 10.

Thus, the player may play an entire football game or boxing match, for example, without having to stay at the machine the entire time, and without having to return to the same machine in the future to conclude the game. This embodiment could further be used, for example, for a player to simulate a season in football, baseball, or any other team sport or a career in boxing, tennis, or any other individual sport. Further, in sports such as horse racing and auto racing, this embodiment could be used to allow the player to build up a stable of horses or a team of automobiles that would be managed over time by the player. Thus, in addition to the payoffs granted by the machine, the player may build up status on the game over time, and these status improvements may be used by casino operators to grant special bonuses.

Furthermore, the saved status of first game may be loaded into the same game or, if certain predetermined requirements are met, into a second game such as a sequel to the first game. For example, if a player fulfilled the game requirements on a first game and saved the status of the "completed" first game at the central database, the saved game status may be loaded into the second game. Loading the saved game status into the second game may, for example, unlock secret features of the second game. Secret features may include bonus rounds, characters, reel symbols, special effects, and other game play elements that are not ordinarily available to a player but are made available if the player saves and loads the status of the "completed" first game into the second game. Thus, the player is motivated to play the first game until fulfilling all of its requirements so that the player can unlock and take advantage of the secret features of the second game.

While the present invention has been described with reference to one or more particular embodiments, those skilled in the art will recognize that many changes may be made thereto without departing from the spirit and scope of the present invention. For example, the basic game may itself be implemented on the video display 12 or on a separate video display. Further, though the present invention has been described as an entire game, those skilled in the art will recognize that the invention could also be implemented as a bonus game for known types of gaming machines. In addition, though the present invention has been described with respect to the portrayal of simulated sporting events, the invention is not limited to portraying simulated sporting events and includes the portrayal of other types of events and actions. Further, though specific embodiments have been described having two displays, the invention may be implemented on machines having only one display and may also be implemented on machines having more than two displays. Each of these embodiments and obvious variations thereof is contemplated as falling within the spirit and scope of the claimed invention, which is set forth in the following claims.

What is claimed is:

1. A method of conducting a game of chance on a gaming machine, comprising:

receiving a wager from a player;

initiating play of the game of chance;

pausing the game of chance;

storing a status of the paused game of chance at a central database linked to and remote from the gaming machine;

receiving another wager at another gaming machine operating a different game of chance;

retrieving the status of the paused game of chance from the central database; and if the status meets predetermined criteria, unlocking an otherwise unavailable feature such that the feature is available to the player in the different game of chance.

2. The method of claim 1, wherein the predetermined criteria is fulfillment of predetermined requirements in the game of chance.

3. A method of conducting a game of chance on a gaming machine, comprising:

receiving a wager from a player to play a first wagering game;

conducting the first wagering game; and if a status of the first wagering game meets predetermined criteria, unlocking an otherwise unavailable feature of a second wagering game such that the feature is available to the player.

4. The method of claim 3, wherein the game of chance includes:

saving the status of the first wagering game; and loading the status into the second wagering game.

5. The method of claim 4, wherein saving the status of the first wagering game includes saving the status at a central database linked to and remote from the gaming machine.

6. The method of claim 3, wherein the unlocking feature is selected from a group consisting of bonus rounds, characters, reel symbols, special effects, and other game play elements.

7. A method for playing a gaming machine, comprising:

receiving a wager from a player;

initiating play of a game of chance;

pausing the game of chance;

storing a status of the paused game of chance at a central database linked to and remote from the gaming machine;

receiving another wager from the player;

retrieving the status of the paused game of chance from the central database;

continuing play of the game of chance beginning from a point at which the game of chance was paused; and wherein if the status meets predetermined criteria, unlocking an otherwise unavailable feature such that the feature is available to the player.

8. A method for playing a gaming machine, comprising:

receiving a wager from a player, initiating play of a game of chance;

pausing the game of chance;

storing a status of the paused game of chance at a central database linked to and remote from the gaming machine;

receiving another wager from the player;

retrieving the status of the paused game of chance from the central database;

continuing play of the game of chance beginning from a point at which the game of chance was paused; and wherein if the status fulfills predetermined requirements in the game of chance, unlocking an otherwise unavailable feature such that the feature is available to the player.

9. A system for conducting a game of chance, comprising:

a gaming machine including means for receiving a wager from a player;

means for initiating play of the game of chance; and means for pausing the game of chance; and a central database for storing a status of the paused game of chance, the central database being linked to and remote from the gaming machine;

means for retrieving the status of the paused game of chance from the central database;

means for continuing play of the game of chance beginning from a point at which the game of chance was paused;

means for receiving another wager; and means, responsive to the status meeting predetermined criteria, for unlocking an otherwise unavailable feature such that the feature is available to the player.

10. A system for conducting a game of chance, comprising:

a gaming machine including means for receiving a wager from a player;

means for initiating play of the game of chance; and means for pausing the game of chance; and a central database for storing a status of the paused game of chance, the central database being linked to and remote from the gaming machine;

means for retrieving the status of the paused game of chance from the central database;

means for receiving another wager;

means for continuing play of the game of chance beginning from a point at which the game of chance was paused; and means responsive to the status meeting predetermined requirements in the game chance, for unlocking an otherwise unavailable feature such that the feature is available to the player.

* * * * *